United States Patent [19]

Jameson

[11] Patent Number: 4,493,264

[45] Date of Patent: Jan. 15, 1985

[54] ELASTIC FRAGMENTATION SLEEVE

[75] Inventor: Robert L. Jameson, Aberdeen, Md.

[73] Assignee: The United States of America as represented by the Secretary of the Army, Washington, D.C.

[21] Appl. No.: 453,670

[22] Filed: Dec. 27, 1982

[51] Int. Cl.[3] ..... F42B 13/18; F42B 1/02

[52] U.S. Cl. ..... 102/491; 102/476; 102/494

[58] Field of Search ..... 102/476, 491, 494, 495, 102/496

[56] References Cited

U.S. PATENT DOCUMENTS 3,474,731 10/1969 Thomanek ..... 102/476

3,799,054 3/1974 LaRocca ..... 102/491

*Primary Examiner*—Charles T. Jordan

*Assistant Examiner*—Ted L. Parr

*Attorney, Agent, or Firm*—Anthony T. Lane; Robert P. Gibson; Edward F. Costigan

[57] ABSTRACT

A means for augmenting the fragmentation of a lightly confined High Explosive Anti-Tank (HEAT) warhead so that it can be used as an area or interdiction weapon. Process involves the placement of an elastic sleeve over the HEAT warhead by the gunner in the field when he feels fragmentation will improve his effectiveness.

5 Claims, 3 Drawing Figures

ELASTIC FRAGMENTATION SLEEVE

GOVERNMENT RIGHTS

The invention described herein may be manufactured, used and licensed by or for the Government for Governmental purposes without the payment to me of any royalties thereon.

BACKGROUND OF THE INVENTION

1. Technical Field

This invention relates to procedures, methods and means which allow the adaption of the warhead of a munition intended for hard targets to one which can destroy a light target, such as personnel and vehicles, with adequate lethality.

2. Prior Art

Formerly a High Explosive Anti-Tank (HEAT) warhead would be either lightly confined with steel or aluminum in order to penetrate the skin of a hard target, such as a tank. In such cases neither warheads had much fragmentation potential due to the mode of fragmentation or the mass.

If an anti-personnel or light point target (trucks or lightly protected targets) warhead was needed either a different weapon or a separate round would have to be used. This added a logistic burden to the infantryman and the supply train.

SUMMARY OF INVENTION

Briefly the foregoing and other objects of the present invention are provided by a fragmentation sleeve which attaches to a warhead which provides a multipurpose munition against soft targets. Fragments of varying mass and size are attached to the sleeve with an adhesive compatible to both the sleeve and fragments.

It is an object of the present invention, therefore, to provide a light fragmenting elastic sleeve which can be carried in a pocket and can be applied to a HEAT round when fragmentation effects are needed.

It is another object of this invention to decrease the logistics burden by reducing the mix of projectiles or rockets required by the infantryman.

Still another object of the present invention is to enhance mobilization; since only one type of round would have to be produced and loaded at a substantial savings in money resources. The attaching fragmentation sleeves could vary round effectiveness depending on the mass and size of the fragments adhered to the sleeve.

Lastly, a heavier round of ammunition need not be used; hence precluding an impact on the principal anti-tank mission.

These and further features and objects of this invention will be apparent from the following description and claims.

DETAIL SPECIFICATION

Figure 1:
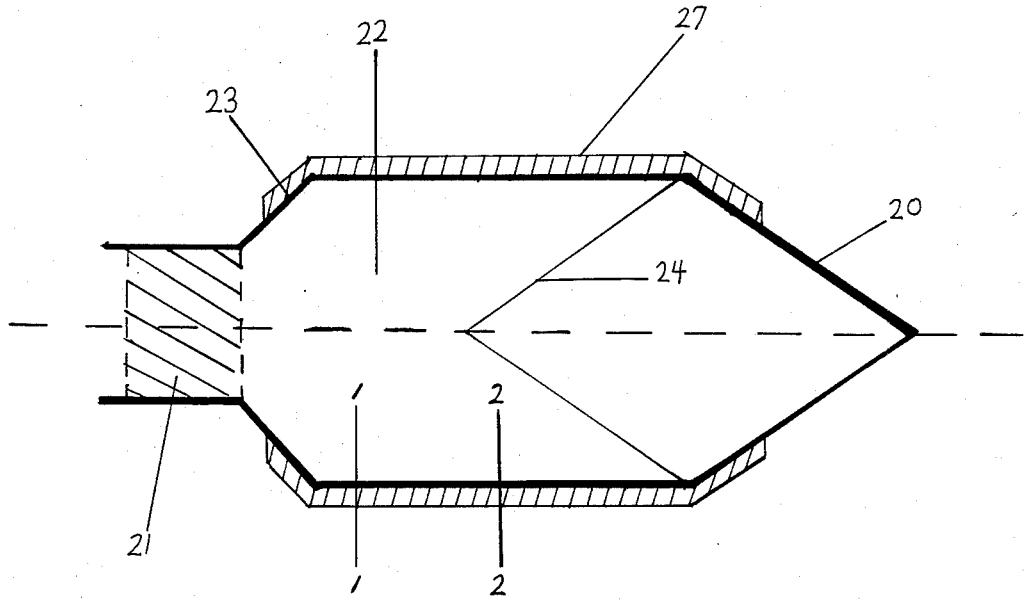
FIG. 1 is a cross-sectional illustration of a normal warhead including the invention of a fragmentation sleeve in its preferred embodiment.

Referring to FIG. 1, the normal warhead has an ogive 20, which contains the fuze or has a double skin as a contact switch. The remaining general components of the warhead are the safe and arming device 21, the high explosive charge 22, the warhead case 23, and the shaped charge liner 24.

In normal function, the fuze functions inside the ogive 20, and the detonator and booster within the safe and arming device 21 detonates, initiating the main explosive charge 22.

The explosive products expand fragmenting the case 23, collapsing the shaped charge liner 24. This action forms a penetrating jet of metal, impinging on the target.

Figure 2:
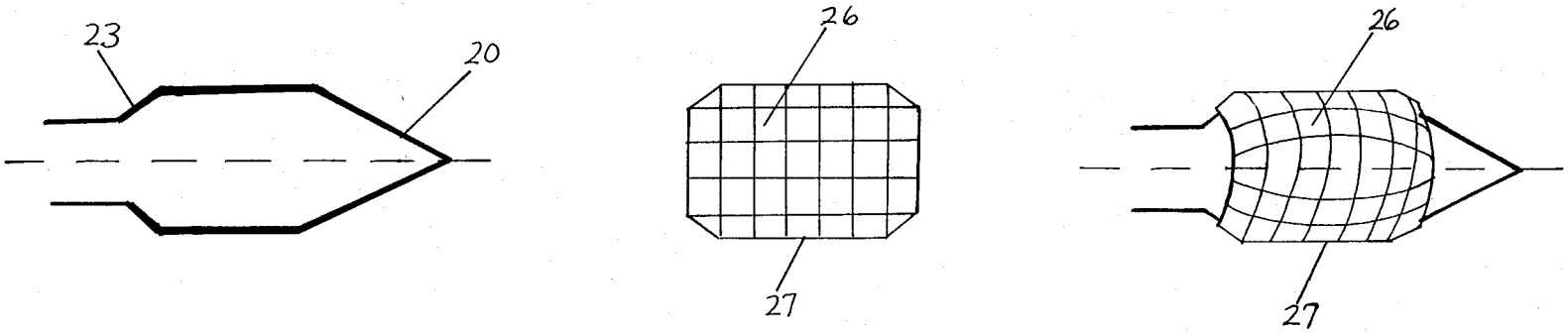
FIG. 2 is an illustration of a fragmentation sleeve inserted over a warhead.

When fragmentation is needed, the sleeve 27, as shown in FIG. 2, with fragments 26 is added by sliding from the ogive 20 end of the warhead over the case 23 and explosive 22. Since the sleeve extends over the forward and rearward sloped surfaces of the warhead shown in FIG. 2, it retains its position on the warhead on launch. The warhead, on contact of the fuze with the target, will function normally but the explosive 22 will expand and fragment the case 23 and propel the fragments 26 shown in FIGS. 2 and 3, toward the target. The greater mass and more compact shape of the fragments 26 on the sleeve 27, as compared to fragments resulting from a conventional thin-walled warhead shell, provide a longer range and greater effectiveness to the warhead fragments. Materials that can be used for the fragment sleeve 27, are elastisized nylon or Spandex woven materials or rubber formable to fit a warhead.

The size of a fragment 26 is a function of the mass, velocity and range needed in the application. The mass of each fragment 26 needed for anti-personnel purposes is in the one grain range. For light targets, such as trucks, fragments 26 with masses of 10 grains are required. Both these sizes are possible on an 80 millimeter warhead with a 0.050 inch aluminum case 23 loaded with 70/30 octol explosive charge 22. The sleeve 27 on an 80 millimeter caliber warhead with 8000 fragments 26 for use against personnel at velocities of 7500 feet per second would weigh 8200 grains. If the fragment 26 mass is increased to five grains, for an equivalent sleeve 27 and fragment 26 weight of 8200 grains, some 1600 fragments 26 at velocities of 4000 feet per second would be possible. The velocities of metal driven by a detonating explosive, presented in this preferred embodiment, have been calculated, using the Gurney equations summarized below:

Symmetric sandwich: $$V_M = \sqrt{2E}\left(\frac{M}{C} + \frac{1}{3}\right)^{-\frac{1}{2}} \quad (1)$$

Flat plate: $V_M =$ (2)

$$\sqrt{2E}\left\{1\left[-\left(\frac{X_M}{X_{MO}}\right)(A+1) - A\right]^{-B/F}\right\}^{\frac{1}{2}} / B^{\frac{1}{2}}$$

Sphere: $$V_M = \sqrt{2E}\left(\frac{M}{C} + \frac{3}{5}\right)^{-\frac{1}{2}}, \quad (3)$$

-continued

Cylindrical tube: $V_M = \sqrt{2E}\left(\frac{M}{C} + \frac{1}{2}\right)^{-\frac{1}{2}}$, where $M/C = [(OD/ID)^2 - 1)]\rho_M/\rho_C$, $X_M$ = position of product gas/metal interface, $X_{MO}$ = initial thickness of explosive, which equals the initial value of $X_M$, $A = (2M/C + 1)/(2N/C + 1)$, $N$ = mass of tamper plate (on explosive surface opposite plate $M$); $N$ may assume any value, $\gamma$ = polytropic exponent of ideal (product) gas, $$B = \frac{N}{C}A^2 + \frac{M}{C} + \frac{1}{3}\ \frac{(1 + A^3)}{(1 + A)},$$

$$F = \frac{M}{C}\left[\frac{(A + 1)}{(\gamma - 1)}\right]$$

$V_M$ = terminal metal velocity, $\sqrt{2E}$ = Gurney characteristic velocity wherein:

$$\sqrt{2E} = 0.6 + 0.54\sqrt{1.44\ \phi\rho_0}\text{, or}$$

$$\sqrt{2E} = 0.887\ \phi^{0.5}\rho_0^{0.4}.$$

Table I below summarizes the velocities, fragment masses, number of fragments 26 and sleeve 27 weights for an 80 millimeter warhead.

TABLE I

| Number of Fragments | Sleeve Characteristics: Frequent Mass | Velocity at Detonation | Sleeve Weight |
|---|---|---|---|
| 8000 | 1 grain | 7500 ft/sec | 8200 grains |
| 1600 | 5 grains | 4000 ft/sec | 8200 grains |

Figure 3:
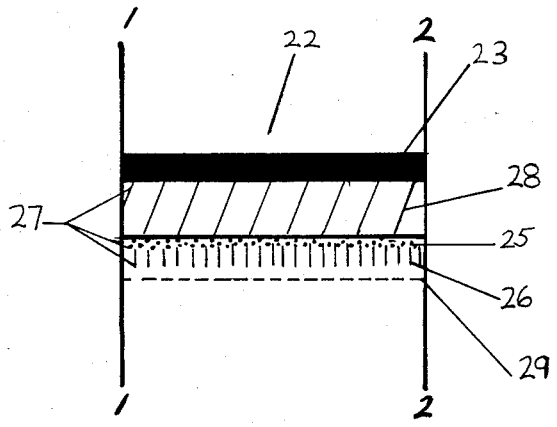
FIG. 3 is a close-up view of a section of the warhead shell between lines 1 and 2, showing the fragmentation sleeve in its preferred embodiment and an alternative embodiment to contain the fragments through the use of the main sleeve and a roll-over sleeve.

The fragments 26 are attached to the elastic sleeve 27 in a number of ways. One embodiment, as shown in FIG. 1, is to attach the fragments 26 with adhesive 25 compatible to both the sleeve material 28 and fragment 26. The adhesive 25 used is a direct function of the sleeve material 28; since it must adhere to the fragment 26 and to the surface of the sleeve 27 material 38. Various adhesives including cyanoacrylates e.g. Eastman 910, silicones, e.g. Silastic adhesive, and particularly epoxy adhesives, are applicable. Another embodiment, as shown in FIG. 3, includes a double skinned sleeve in which the fragments 26 are attached by adhesive 25 to the main sleeve 27 but are retained by a thin oversleeve 29 without fragments which can be slipped over the ogive 20 and shaped charge liner 23. Such a double skinned sleeve can be preformed external to the projectile, or formed by slipping a second elastic sleeve over the first elastic sleeve containing the attached fragments previously mounted on the projectile.

The foregoing disclosure and drawings are merely illustrative of the principles of this invention and are not to be interpreted in a limiting sense. I wish it to be understood that I do not desire to be limited to the exact details of construction shown and described because obvious modifications will occur to a person skilled in the art.

I claim:

1. In an improved device for use to augment the fragmentation of a high-explosive anti-tank missile having a body, the improvement consisting essentially of a light-weight, hand-carried elastic base sleeve for use in the field to snugly and separably cover said body of said missile, a plurality of metal fragments, and means for adhering said fragments to said sleeve.

2. The device of claim 1 wherein each of said fragments have masses of about 1 grain.

3. The device of claim 1 wherein each of said fragments have masses of about 10 grains.

4. The device of claim 1 having a second sleeve for separably covering said fragments adhered to said base elastic sleeve.

5. The device of claim 4 wherein said base sleeve having adhered fragments and said second cover sleeve consists of a double-skinned sleeve unit.

* * * * *